United States Patent [19]

Clune et al.

[11] 4,013,914

[45] Mar. 22, 1977

[54] ELECTRODE PROTECTING MEANS FOR ELECTRIC DISCHARGE LAMPS

[75] Inventors: James P. Clune, Middleton; Harry W. Aptt, Gloucester; Sebastian J. Marci, Middleton, all of Mass.

[73] Assignee: North American Philips Corporation, New York, N.Y.

[22] Filed: Nov. 26, 1975

[21] Appl. No.: 635,418

[52] U.S. Cl. ..... 313/313; 313/107; 313/204; 313/207

[51] Int. Cl.[2] ..... H01J 1/52; H01J 19/40

[58] Field of Search ..... 313/313, 107, 204, 205, 313/207

[56] References Cited

UNITED STATES PATENTS

| | | | |
|---|---|---|---|
| 2,300,997 | 11/1942 | Van Horn | 313/348 X |
| 2,824,255 | 2/1958 | Mistler | 313/217 X |
| 2,946,909 | 7/1960 | Morehead | 313/207 X |
| 3,005,930 | 10/1961 | Mason | 313/207 X |
| 3,215,882 | 11/1965 | Toomey | 313/207 X |
| 3,898,503 | 8/1975 | Shurgan | 313/207 |
| 3,914,637 | 10/1975 | Bennett | 313/313 |

*Primary Examiner*—Saxfield Chatmon, Jr.
*Attorney, Agent, or Firm*—Frank R. Trifari; George B. Berka

[57] ABSTRACT

A fluorescent lamp having two opposite electrodes, wire probes located near the electrodes for collecting electrons during the positive half-cycle on an electrode, and a coating of a dielectric material, such as boron nitride, on each probe for storing some collected electrons and attracting a part of positive ions during the negative half-cycle.

2 Claims, 2 Drawing Figures

ELECTRODE PROTECTING MEANS FOR ELECTRIC DISCHARGE LAMPS

This invention relates generally to gas or vapor discharge lamps such as fluorescent lamps, for example and more particularly it relates to means for protecting the lamp against the creation of dark ends.

In operation of the discharge lamp, the electrodes and their supporting members are subject to positive ion bombardment during the negative half-cycle on an electrode, which bombardment is particularly heavy during the starting period. In heavy duty lamps, such as high output lamps operating with current of 800 milliamperes, or very high output lamps operating at 1,5 amperes, the intense bombardment by positive ions contributes to early tube end darkening and short life of the tube due to the depletion of the cathode emitter material. On the other hand, certain amount of ion bombardment is necessary to maintain the cathode temperature which is needed for efficient emission, but the partial ion bombardment has hitherto been uncontrollable.

It has been also known to use wire probes mounted close to the electrodes and electrically connected thereto to act as collector of electrons during the positive half-cycle on respective electrodes. Nonetheless, the wire probes do not protect the cathode emissive area against excessive positive ion bombardment during the negative half-cycle.

Accordingly, it is an object of this invention to provide means which would protect the cathode emitter material against depletion due to the excessive positive ion bombardment.

Another object of this invention is to avoid darkening of the ends of the lamp and to prolong its operational life.

According to the invention, the above objects are obtained by providing wire probes which are mounted close to the electrode and electrically connected thereto, and by coating each wire probe with dielectric material having very low electron leakage. The dielectric coating stores some of the electrons collected during the positive half-cycle on the electrode and, consequently, attracts during a negative half-cycle a part of positive ions impinging upon the electrode.

Figure 1:
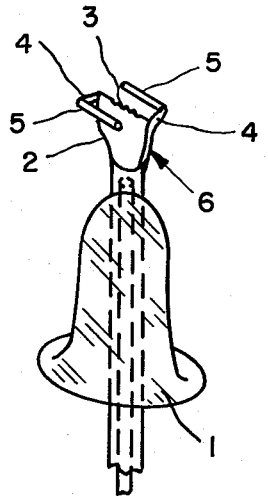
Figure 2:
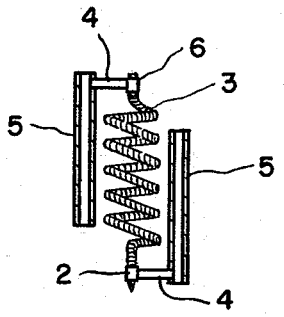

An embodiment of the invention will now be described, by way of example, with reference to the accompanying diagrammatical drawing in which:

FIG. 1 illustrates an elevation view of a mount at one end of a discharge lamp, and FIG. 2 is a top view of the electrode as shown in FIG. 1.

Referring now to the figures, a glass mount 1 as shown in FIG. 1, supports lead-in wires 2 and 6 which in turn support a spiral electrode 3 of a cathode emitter material. Two wire probes 4 are electrically connected to each lead-in wire 2 and 6 and extend parallel to the electrode 3. The theory underlying the use of the wire probes 4 is that they increase the anode area during the positive half-cycle and act as a collector of electrons. According to this invention, at least a part of wire probes 4 which extends parallel with the spiral 3 is covered with a dielectric, charge storing material 5, like boron nitride which has very low electron leakage and could store some of the collected electrons which in turn attract some of the positive ions away from the cathode during the negative potential on the electrode 3. In this way it is possible to control the bombardment of the cathode during the operation of the lamp.

Tests have been made with discharge tubes where end darkening normally begins to appear after 500 to 700 hours; by using the probes with the charge storing boron nitride coating accoording to this invention, dark ends of the lamp were not observed until after about 2,500 hours so that the life of the tube has been substantially increased.

We wish it to be understood that we do not desire to be limited to the exact details of construction shown and described, for obvious modifications will occur to a person skilled in the art.

Having described the invention, what we claim as new and desire to be secured by Letters Patent, is as follows:

1. A discharge tube comprising two electrodes, at least one wire probe electrically connected to each electrode and mounted in proximity thereto to act as a collector of electrons during a positive half-cycle on an electrode and, on each wire probe, a coating of a dielectric material having very low electron leakage to store some of the collected electrons and to attract during a negative half-cycle a part of positive ions impinging upon the electrode.

2. A discharge tube as claimed in claim 1, wherein said coating is boron nitride.

* * * * *